US009033763B2

(12) United States Patent
Okoshi et al.

(10) Patent No.: US 9,033,763 B2
(45) Date of Patent: May 19, 2015

(54) DEBURRING DEVICE

(75) Inventors: Masakatsu Okoshi, Fukushima (JP); Tatsuya Yahagi, Fukushima (JP)

(73) Assignee: HITACHI AUTOMOTIVE SYSTEMS, LTD., Ibaraki (JP)

( * ) Notice: Subject to any disclaimer, the term of this patent is extended or adjusted under 35 U.S.C. 154(b) by 318 days.

(21) Appl. No.: 13/483,451

(22) Filed: May 30, 2012

(65) Prior Publication Data

US 2012/0309279 A1 Dec. 6, 2012

(30) Foreign Application Priority Data

May 31, 2011 (JP) ..... P2011-121609

(51) Int. Cl.
*B24B 1/00* (2006.01)
*B24B 31/02* (2006.01)
*B24B 9/00* (2006.01)

(52) U.S. Cl.
CPC ..... *B24B 31/02* (2013.01); *B24B 9/007* (2013.01)

(58) Field of Classification Search
CPC .. B24B 31/003; B24B 31/006; B24B 31/0224
USPC ..... 451/44, 49, 61, 104, 106, 113, 177, 451/328, 541, 36
See application file for complete search history.

(56) References Cited

U.S. PATENT DOCUMENTS

| | | | | |
|---|---|---|---|---|
| 2,883,809 | A * | 4/1959 | Simjian | 451/36 |
| 5,823,861 | A * | 10/1998 | Kobayashi et al. | 451/326 |
| 6,572,458 | B2 * | 6/2003 | Lim | 451/113 |
| 6,960,116 | B2 * | 11/2005 | McNeil et al. | 451/36 |
| 6,962,522 | B1 * | 11/2005 | Kawasaki et al. | 451/113 |
| 7,048,613 | B2 * | 5/2006 | Rudiger | 451/36 |
| 8,657,647 | B2 * | 2/2014 | Baudimont et al. | 451/8 |

FOREIGN PATENT DOCUMENTS

| | | |
|---|---|---|
| JP | 62-172554 | 11/1987 |
| JP | 06-008131 | 1/1994 |
| JP | 2002-011667 | 1/2002 |
| JP | 2002-046056 | 2/2002 |
| JP | 2004-351451 | 12/2004 |

OTHER PUBLICATIONS

Office Action Issued in Japanese Patent Application No. 2011-121609 on Jan. 20, 2015 With English Language Translation of Thereof.

* cited by examiner

*Primary Examiner* — Timothy V Eley
(74) *Attorney, Agent, or Firm* — Nixon & Vanderhye P.C.

(57) ABSTRACT

A deburring device includes a barrel with a granulated polishing member filled therein. The barrel is configured by a case formed with an opening hole, and drop prevention member which is fixed to the case and prevents the polishing member from being dropped from the opening hole. A gap into which a tubular end section of a workpiece is inserted is formed between the opening hole of the case and the drop prevention member.

21 Claims, 3 Drawing Sheets

DEBURRING DEVICE

BACKGROUND OF THE INVENTION

1. Field of the Invention

The present invention relates to a deburring device.

This application claims priority to and the benefit of Japanese Patent Application No. 2011-121609 filed on May 31, 2011, the disclosure of which is incorporated herein by reference.

2. Background Art

As a device that removes burrs from a work, there is a configuration in which the burrs are removed by rotating the work in a plurality of media accommodated in a barrel (for example, see Japanese Unexamined Patent Application, First Publication No. 2002-46056).

Furthermore, there is a technique concerning the work of a tubular end section of a workpiece (for example, see Japanese Unexamined Patent Application, First Publication No. 2004-351451)

Based on the background art mentioned above, it is required to remove the burrs of the tubular end section of the workpiece by a simple structure.

SUMMARY OF THE INVENTION

The present invention provides a deburring device capable of removing the burrs of the tubular end section of the workpiece by a simple structure.

According to a first aspect of the present invention, there is provided a deburring device which includes a barrel with a granulated polishing member filled therein and removes burrs of a tubular end section of a workpiece from the workpiece. The barrel is configured by a case formed with an opening hole, and a drop prevention member which is fixed to the case and prevents the polishing member from being dropped from the opening hole. A gap into which the tubular end section of the workpiece is inserted is formed between the opening hole of the case and the drop prevention member.

An elastic member may be arranged in the case.

According to a second aspect of the present invention, a driving device for rotating the barrel in normal rotation and reverse rotation are arranged on a first of the barrel. Clamp device for clamping the workpiece are arranged on a second side of the barrel.

The case may have a cylindrical shape and a protrusion may be provided on an inner circumferential surface thereof.

According to a third aspect of the present invention, the case has a case main body opened at a first end thereof, and a lid member which has the opening hole and is attached to the first end side of the case main body.

The workpiece may be a cylinder used in a shock absorber.

According to the deburring device mentioned above, the burrs of the tubular end section of the workpiece can be removed by the simple structure.

DETAILED DESCRIPTION OF THE INVENTION

Hereinafter, an embodiment of the present invention will be described with reference to the accompanying drawings.

Figure 1:
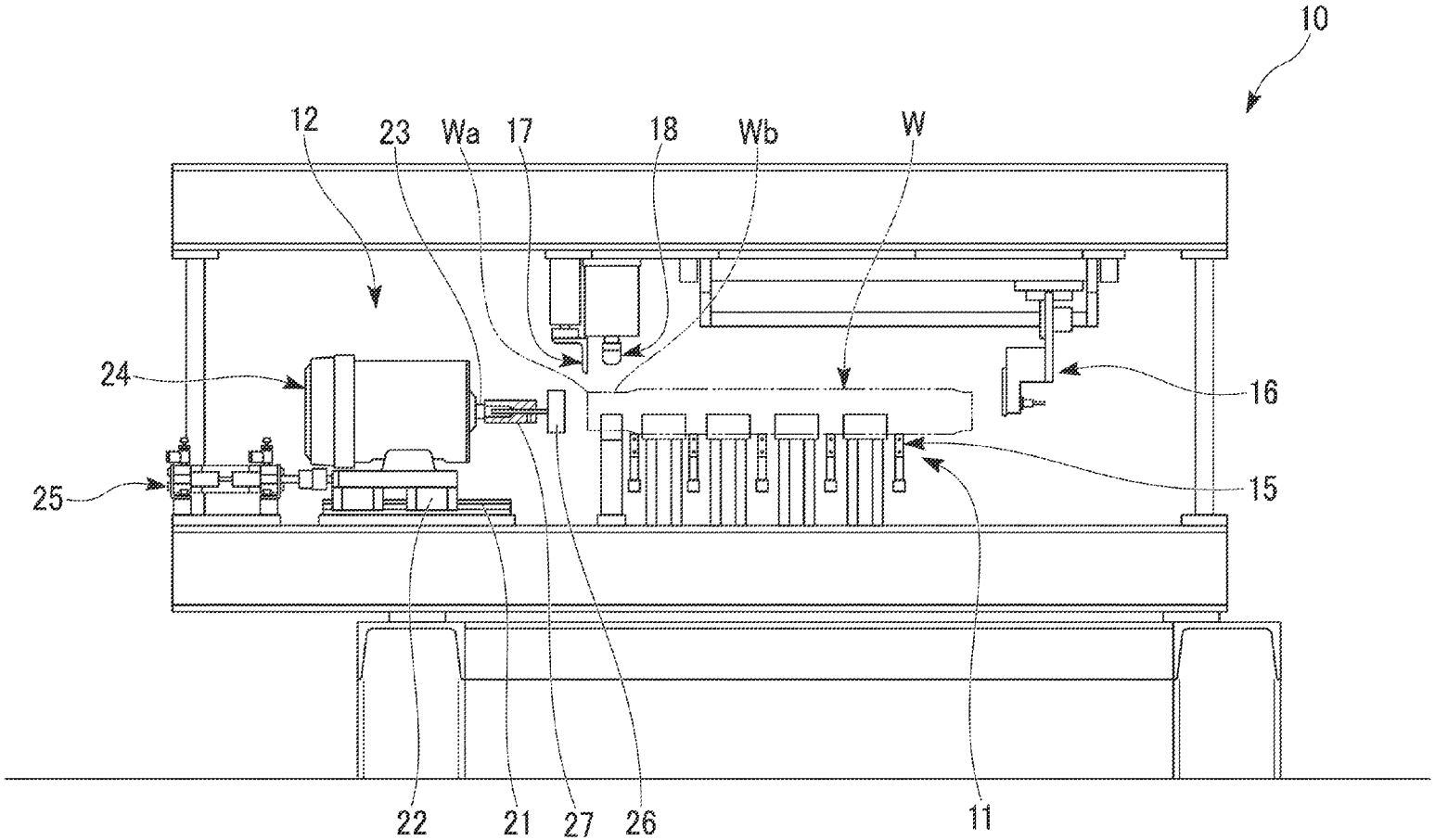
FIG. 1 is a side view showing a deburring device according to an embodiment of the present invention.

As shown in FIG. 1, a deburring device 10 of the present embodiment is a device that removes the burrs of a tubular end section Wa of a metallic workpiece W generally forming a tubular shape from the workpiece W. The deburring device 10 has a workpiece set section 11 provided on a first in a horizontal direction to position and hold the workpiece W, and a deburring section 12 provided on an opposite side in the horizontal direction to remove the burrs of the tubular end section Wa of the workpiece W.

The workpiece set section 11 has a mounting table 15, a sideways shifting section 16, a stop section 17, and a clamp section (clamp device) 18. The workpiece W is mounted on the mounting table 15 in a state in which a central axis thereof is arranged horizontally. The sideways shifting section 16 is arranged on the upper side of the mounting table 15. The sideways shifting section 16 presses the workpiece W mounted on the mounting table 15 from the opposite side of the deburring section 12 to move the workpiece W forward to the deburring section 12 side. The stop section 17 is configured so as to be vertically movable, and stops the workpiece W moved forward up to a predetermined clamp position by the sideways shifting section 16. The clamp section 18 clamps the workpiece W stopped in the clamp position from the top and bottom by the sideways shifting section 16 and the stop section 17.

The workpiece W is positioned in a radial direction by being mounted on the mounting table 15. Furthermore, the workpiece W is positioned in an axial direction by being moved forward to the clamp position by the sideways shifting section 16 and the stop section 17. The clamp section 18 clamps the workpiece W positioned in the radial direction and the axial direction in this way. At this time, the clamp section 18 clamps a neck portion Wb on the inside in the axial direction behind the tubular end section Wa.

The deburring section 12 has a guide rail 21, a slider 22, a motor (driving device) 24, an axial driving section 25, and a hollow fixing jig 27. The guide rail 21 is laid so as to follow the center axis of the workpiece W mounted on the mounting table 15. The slider 22 slides along the guide rail 21. The motor 24 is fixed onto the slider 22 in a state in which the rotation shaft 23 is parallel to the guide rail 21 and is projected to the workpiece set section 11 side. The axial driving section 25 pushes and pulls the motor 24 from an opposite side of the workpiece set section 11 to move the motor 24 and the slider 22 along the guide rail 21 back and forth in the axial direction. The barrel 26 is provided on the same axis as the rotation shaft 23 of the motor 24. The fixing jig 27 fits the rotation shaft 23 of the motor 24 to a first end and fits the barrel 26 to a second end, thereby connecting them integrally.

Figure 2:
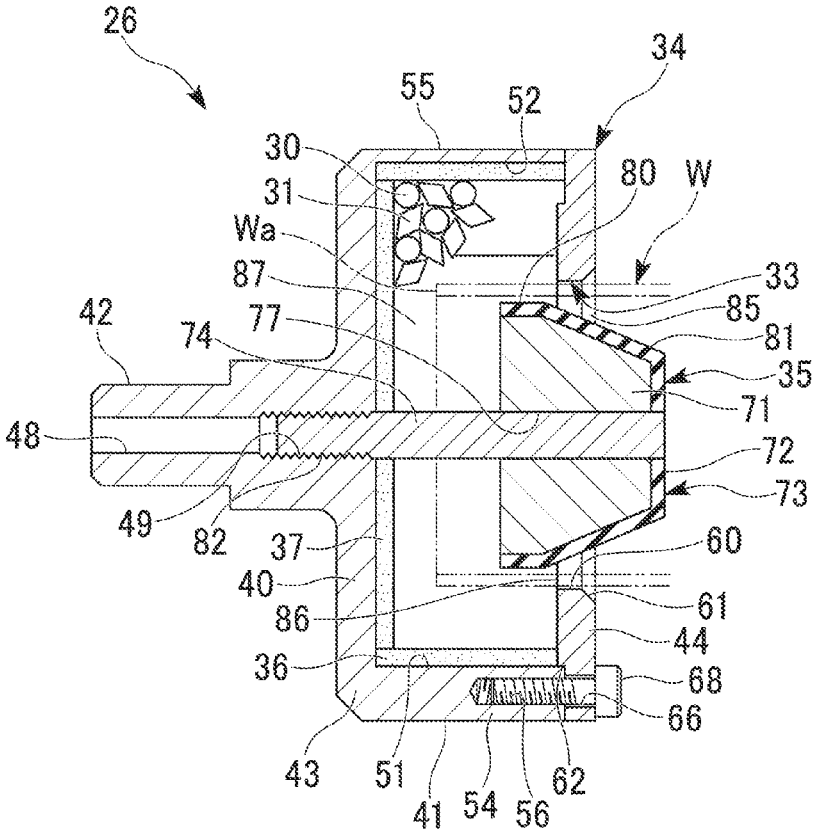
FIG. 2 is a side cross-sectional view showing a barrel of the deburring device according to the embodiment of the present invention.

As shown in FIG. 2, an inner portion of the barrel 26 is filled with a plurality of polishing members 30 formed of a granular spherical body and a plurality of polishing members 31 formed of a granular polyhedron. The barrel 26 includes a case 34 formed with an opening hole 33, a drop prevention member 35 which is fixed to the case 34 and prevents the polishing members 30 and 31 from being dropped from the opening hole 33, and sheet-like elastic members 36 and 37 made of a synthetic resin having a constant thickness arranged in the case 34.

Figure 3:
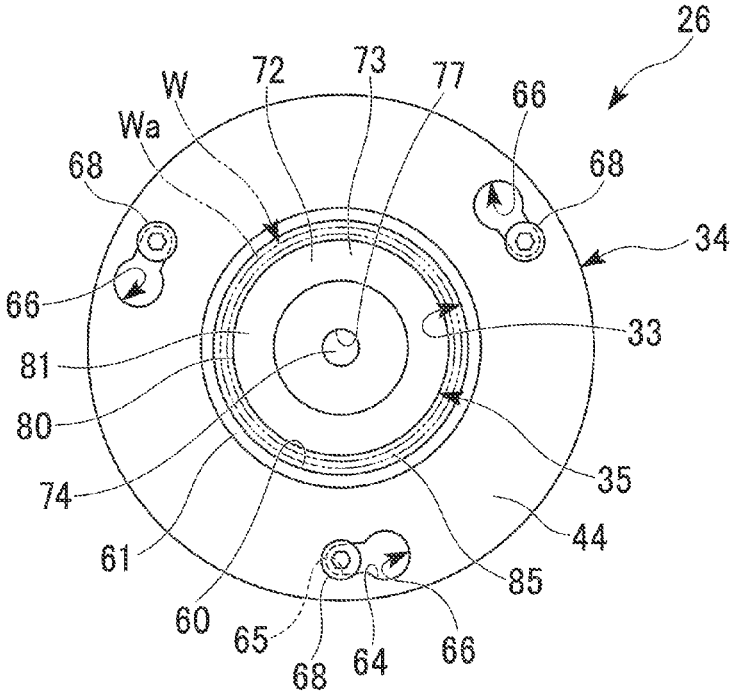
FIG. 3 is a front view showing the barrel of the deburring device according to the embodiment of the present invention.

The case 34 has an integral metallic case main body 43 which includes a discoidal bottom section 40, a cylindrical side wall section 41 projected from an outer peripheral edge portion of the bottom section 40 to the first in the axial direction, and an attachment shaft section 42 projected from the center of the bottom section 40 to the second side thereof in the axial direction. The case main section 43 is opened in the first end thereof opposite to the bottom section 40 of the side wall section 41. Furthermore, the case 34 has a discoidal metallic lid member 44 attached so as to cover the opening of the first end side of the case main body 43. The lid member 44 is shown in FIG. 3. Additionally, the case 34 and the lid member 44 are preferably made from a metal but may be made of resin.

The case main body 43 shown in FIG. 2 is fitted and fixed to the fixing jig 27 shown in FIG. 1 in the attachment shaft section 42. As a consequence, the case main body 43 is fixed to the rotation shaft 23 of the motor 24. As shown in FIG. 2, the bottom section 40 and the attachment shaft section 42 are formed with a through hole 48 in the center thereof. The bottom section 40 side of the through hole 48 is formed with a female screw 49. When the barrel 26 is in a state of being attached to the motor 24, the center of the through hole 48 coincides with that of the rotation shaft 23 of the motor 24.

Figure 4:
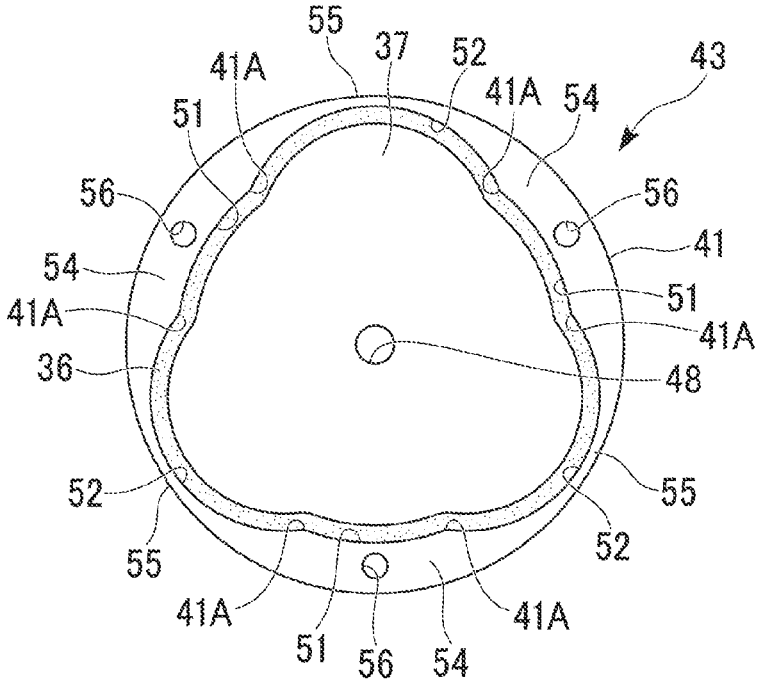
FIG. 4 is a front view showing a case main body of the barrel of the deburring device according to the embodiment of the present invention.

As shown in FIG. 4, the side wall section 41 of the case main body 43 is a cylindrical surface, a center of an outer circumferential surface of which coincides with that of the through hole 48. Meanwhile, on an inner circumferential surface of the side wall section 41, small-diameter sections 51 having a large radius of curvature and a small maximum outer diameter, and large-diameter sections 52 having a small radius of curvature and a large maximum outer diameter are alternately arranged in three locations, and a protrusion section 41A is formed between the small-diameter section 51 and the large-diameter section 52. The small-diameter sections 51 of three locations arranged in the case main body 43 are configured by the same cylindrical surface having the center corresponding to that of the through hole 48, and circumferential lengths thereof are formed equally. The large-diameter sections 52 of three locations arranged in the case main body 43 are configured by the cylindrical surface of the same diameter having the center on the cylindrical surface having the center corresponding to the through hole 48, and circumferential lengths thereof are formed equally. From the above, the side wall section 41 constitutes a thick section 54 in which the position of the small-diameter section 51 is thicker than that of the large-diameter section 52 as a whole. Furthermore, the side wall section 41 constitutes a thin section 55 in which the position of the large-diameter 52 is thinner than that of the thick section 54 as a whole. Moreover, screw holes 56 are formed in the centers of the respective thick sections 54 in the circumferential direction and in the radial direction.

The elastic member 36 is an elastomer such as a rubber or a urethane. The elastic member 36 is affixed to the entire surface of the inner circumferential surface of the side wall section 41 of the case main body 43. In other words, the elastic member 36 is provided for all the small-diameter sections 51 and all the large-diameter sections 52. Furthermore, as shown in FIG. 2, the elastic member 37 is affixed to the entire surface of the bottom surface of the bottom section 40.

The lid member 44 has the circular opening hole 33 in the center thereof in the radial direction. The opening hole 33 penetrates the lid member 44 in the axial direction, the first thereof in the axial direction becomes a cylindrical inner circumferential surface 60 of a constant diameter, and the second side thereof in the axial direction becomes a tapered inner circumferential surface 61 in which the diameter becomes larger away from the cylindrical inner circumferential surface 60. An inner diameter of the cylindrical inner circumferential surface 60 of the opening hole 33 is formed to be slightly larger than an outer diameter of the tubular end section Wa so that the tubular end section Wa of the workpiece W can be inserted. Furthermore, in the lid member 44, on the cylindrical inner circumferential surface 60 side of the axial direction, a fitting section 62 having a diameter smaller than that of other portions is formed to match the center with the opening hole 33. Additionally, in the lid member 44, on the outside of the fitting section 62 in the radial direction, as shown in FIG. 3, a plurality of composite holes 66 configured by large-diameter hole sections 64 with a large diameter and small-diameter hole sections 65 with a small diameter are formed on a circle having a center matching that of the opening hole 33 so that the orientations of the circumferential direction match each other.

In a case of attaching the lid member 44 to the case main body 43, the lid member 44 is set to a posture in which the fitting section 62 shown in FIG. 2 faces the case main body 43 side, with respect to the case main body 43 in which the hexagonal socket head bolt 68 is screwed into the screw hole 56 in advance. In this posture, the hexagonal socket head bolt 68 passes through the large-diameter hole section 64 of the complex hole 66 shown in FIG. 3, and the fitting section 62 is screwed into the inner circumferential section of the small-diameter section 51 of the side wall section 41. Moreover, after rotating the lid member 44 so that the hexagonal socket head bolt 68 is positioned in the position of the small-diameter hole section 65, the hexagonal socket head bolt 68 is tightened. In this way, the lid member 44 is attached to the end section of the opening side of the case main body 43, and the hexagonal socket head bolt 68, the lid member 44, the case main body 43 and the elastic members 36 and 37 are integrated to form the case 34. In this state, the center of the opening hole 33 of the lid member 44 matches that of the through hole 48 of the case main body 43, and the center matches that of the rotation shaft 23 by being attached to the rotation shaft 23 of the motor 24. The case 34 is formed with the opening hole 33 in the center thereof in the radial direction.

As shown in FIG. 2, the drop prevention member 35 includes a member main body 73 configured so as to cover a surface of a metallic core member 71 with a flexible layer 72 such as rubber, and a metallic pin 74 fitted to the member main body 73 at the first end side thereof in the axial direction. The member main body 73 is formed with a fitting hole 77 into which the pin 74 is fitted and fixed, in the center of the core member 71. Furthermore, the outer circumferential surface formed from the layer 72 of the member main body 73 is a cylindrical outer circumferential surface 80 of a constant diameter in which the center thereof matches that of the pin 74 by the protrusion side of the pin 74. Furthermore, the side of the outer circumferential surface opposite to the protrusion side of the pin 74 is a tapered outer circumferential surface 81 in which the diameter becomes smaller away from the cylindrical outer circumferential surface 80 by matching the center thereof with that of the pin 74. The outer diameter of the cylindrical outer peripheral surface 80 of member main body 73 is formed to be slightly smaller than the inner diameter of the tubular end section Wa so as to be able to enter the tubular end section Wa of the workpiece W.

On the side of the pin 74 opposite to the member main body 73, a male screw 82 is formed. The drop prevention member 35 is screwed with the female screw 49 of the attachment shaft section 42 of the case main body 43 in the male screw 82. As a result, the drop prevention member 35 is fixed to the case 34. In this manner, the center of the opening hole 33 of the case 34 matches the center of the drop prevention member 35 in the state of being fixed to the case 34, and thus, a gap 85 forming a circular shape as viewed from the axial direction is formed therebetween. The tubular end section Wa of the workpiece W is inserted into the gap 85.

Herein, in the state in which the drop prevention member 35 is fixed to the case 34 as mentioned above, the tapered outer circumferential surface 81 is arranged so as to cross over the entire length of the opening hole 33 in the axial direction. That is, the end portion of the small-diameter side of the tapered outer circumferential surface 81 is positioned on the outside of the case 34 of the lid member 44 in the axial direction behind the opening hole 33, and the end portion of the large-diameter side of the tapered outer circumferential surface 81 is positioned on the inside of the case 34 of the lid member 44 in the axial direction behind the opening hole 33. In other words, the tapered outer circumferential surface 81 is projected outward in the axial direction behind the opening hole 33 of the case 34, and stands back inward in the axial direction behind the opening hole 33 of the case 34. Thus, the cylindrical outer circumferential surface 80 of the member main body 73 is positioned on the inside in the axial direction behind the opening hole 33 of the case 34 as a whole.

In addition, the drop prevention member 35 is attached to the case main body 43 in the state before the lid member 44 is attached. In this manner, in the state in which the drop prevention member 35 is fixed to the case main body 43, a plurality of polishing member 30 and a plurality of polishing members 31 are put into the gap 85. Moreover, in this manner, the lid member 44 is fixed to the case main body 43 in the state in which the polishing members 30 and 31 are arranged by the hexagonal socket head bolt 68 to form the barrel 26.

Herein, in the circular gap 85 between the opening hole 33 of the case 34 and the drop prevention member 35, a portion in which a distance between the end edge portion of the opposite side of the tapered inner circumferential surface 61 of the cylindrical inner circumferential surface 60 of the opening hole 33 and the tapered outer circumferential surface 81 of the drop prevention member 35 is minimum constitutes the narrowest minimum gap section 86. At least the minimum gap section 86 is configured to be narrower than any particle diameter (a length of the portion having the minimum length) of the prescribed polishing members 30 and 31 in the new state. Thus, the gap 85 is configured so that none of the polishing members 30 and 31 of the new state pass therethrough. In addition, non-specified polishing members 30 and 31 such as a chipped polishing member may pass through the gap 85.

A filling amount of the polishing members 30 and 31 to a filling space 87 positioned inside the minimum gap section 86 in the barrel 26 is an amount which makes it impossible for the tubular end section Wa of the workpiece W to enter the filling space 87 via the gap 85 if there is no elastic deformation of the elastic members 36 and 37. Specifically, an amount is adopted which fills the filling space 87. On the other hand, even if an allowance amount of the elastic deformation of the elastic members 36 and 37 fully fills the polishing members 30 and 31 as mentioned above, an amount is adopted which makes it possible for the tubular end section Wa of the workpiece W to enter the filling space 87 via the gap 85. That is, an amount capable of securing an escape value is used. In addition, if the escape value can be secured when inserting the tubular end section Wa of the workpiece W into the case 34, the elastic members 36 and 37 may be provided on any one of the inner surface of the side wall section 41 of the case main body 43, the inner surface of the bottom section 40, and the inner surface of the lid member 44. Furthermore, the elastic member may be partially provided in the respective inner surfaces. Furthermore, even when the performance declines, if the filling amounts of the polishing members 30 and 31 are reduced, the elastic members 36 and 37 may not be provided.

As shown in FIG. 1, the barrel 26 as mentioned above is fixed to the rotation shaft 23 of the motor 24 via the fixing jig 27. In this state, the motor 24 for rotating the barrel 26 forward and backward is arranged on a first of the barrel 26 in the axial direction, and the clamp section 18 for clamping the workpiece W is arranged on the second side of the barrel 26 in the axial direction.

For example, the workpiece W mentioned above is formed by being cut from an elongated tubular material. When cutting the material, burrs are generated in the tubular end section Wa used as the cutting end. The burrs generated in the tubular end section Wa are removed by the use of the deburring device 10 mentioned above.

Figure 5:
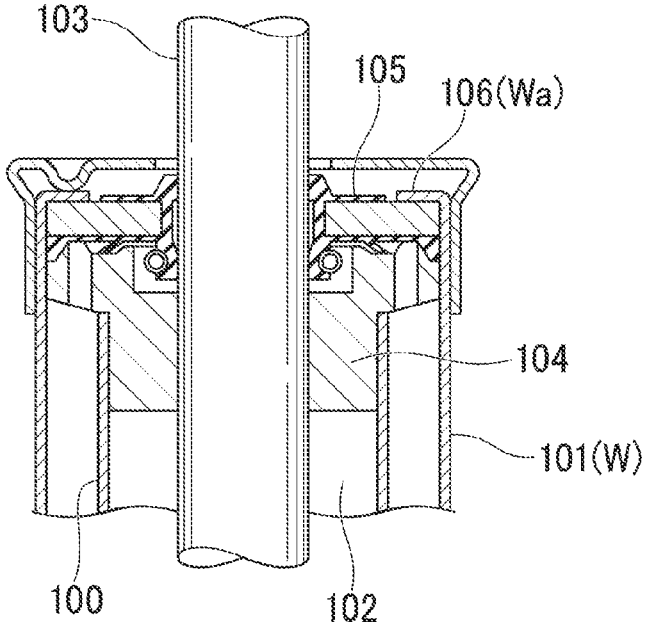
FIG. 5 shows a workpiece or the like on which the deburring is performed by the deburring device according to the embodiment of the present invention.

Specifically, the workpiece W mentioned above is a cylinder used in a shock absorber. As shown in FIG. 5, the shock absorber includes a shock absorber of a double cylinder type having a cylindrical internal cylinder 100 sealed with liquid oil as a working fluid and an external cylinder 101 covering the internal cylinder 100, and a shock absorber of a single cylinder type having one cylinder (not shown).

In the shock absorber of the double cylinder type shown in FIG. 5, a piston (not shown) partitioning the inner portion of the internal cylinder 100 into an upper chamber 102 and a lower chamber (not shown) is slidably fitted into the internal cylinder 100. A piston rod 103 connected to the piston is inserted into a rod guide 104 and a seal ring 105 fitted to the internal cylinder 100 and the external cylinder 101 and is extended to the outside of the internal cylinder 100 and the external cylinder 101. The opening side of the external cylinder 101 is caulked on the inside to form a caulking section 106. The seal ring 105 is engaged between the caulking section 106 and the rod guide 104. Particularly, it is important to reliably remove the burrs of the tubular end section of the external cylinder 101 without damaging the seal ring 105 that is easily damaged. Similarly, in the shock absorber of the single cylinder type, there is also a type in which the opening side of the cylinder is caulked inward to engage the seal ring. With regard to such a cylinder, it is also important to reliably remove the burrs of the tubular end section. Thus, such a cylinder is used as the workpiece W, and the deburring is performed on the tubular end section Wa including the caulking section 106 coming into contact with the seal ring 105 by the use of the deburring device 10 mentioned above.

In the case of performing the deburring of the tubular end section Wa of the workpiece W using the deburring device 10 as mentioned above, a worker mounts the workpiece W on the mounting table 15 in the posture in which the tubular end section Wa to be deburred faces the barrel 26, and pushes a start button. Then, in the deburring device 10, after the stop section 17 is lowered, the sideways sifting section 16 is moved forward to move the workpiece W to the clamp position abutting the stop section 17. After that, the clamp section 18 clamps the neck section Wb of the workpiece W. In addition, when the clamp section 18 clamps the workpiece W, the side shifting section 16 is moved in reverse and the stop section 17 is raised.

In the deburring device 10, after clamping the workpiece W using the clamp section 18, the axial driving section 25 moves the motor 24 and the barrel 26 forward to a predetermined position of the workpiece W side. The tubular end section Wa of the workpiece W then enters the gap 85 between the opening hole 33 of the case 34 of the barrel 26 and the drop prevention member 35. At this time, the tapered inner circumferential surface 61 of the opening hole 33 guides the outer circumferential side of the tubular end section Wa, and the tapered outer circumferential surface 81 of the drop prevention member 35 guides the inner circumferential side of the tubular end section Wa. As a result, the tubular end section Wa smoothly passes through the inside of the cylindrical inner circumferential surface 60 of the opening hole 33, and then reaches between the member main body 73 of the drop prevention member 35 and the bottom section 40 of the case 34 through the outside of the cylindrical outer circumferential surface 80 of the drop prevention member 35. Furthermore, at this time, the workpiece W presses the polishing members 30 and 31 and enters the barrel 26 while elastically deforming the elastic members 36 and 37.

As a result, the tubular end section Wa of the workpiece W is pressed against the polishing members 30 and 31 in the barrel 26 by suitable pressing force using the reaction force of the elastic members 36 and 37. In this state, in the deburring device 10, the motor 24 rotates the barrel 26 in the normal rotation and reverse rotation for a predetermined time (for example, 4 to 5 seconds), respectively. The polishing members 30 and 31 filled in the barrel 26 are then relatively moved while coming into contact with the tubular end section Wa with pressure, and scrape and remove the burrs. At this time, the small-diameter sections 51 provided between the large-diameter sections 52 of the side wall section 41 of the case 34 function as a stopper of the movement of the polishing members 30 and 31. As a consequence, the polishing members 30 and 31 enter a substantially stopped state with respect to the relatively rotating tubular end section Wa, to thereby satisfactorily scrape the burrs from the tubular end section Wa.

Moreover, the barrel 26 is rotated in the normal rotation and reverse rotation for a predetermined time. Thereafter, after stopping the motor 24, the axial driving section 25 moves the motor 24 and the barrel 26 backward and separates them from the workpiece W. After separating the barrel 26 from the workpiece W, the clamp section 18 releases the clamp of the workpiece W. In this manner, the deburring of one workpiece W is finished.

As in the technology described in Japanese Unexamined Patent Application, First Publication No. 2004-351451 mentioned above, in the cylinder of the shock absorber engaging the seal ring by bending the tubular end section, when there are burrs in the bent tubular end section, there is a possibility for the seal ring to become damaged and, for example, oil sealed in the inner portion of the cylinder may leak out. For this reason, there is a need to reliably remove the burrs. In addition, although the burrs are generated in a case in which the tubular end section is formed by the cutting processing in many cases, in a case of performing the parallel swage processing in the tubular end section Wa as in Japanese Unexamined Patent Application, First Publication No. 2004-351451, in some cases, the burrs are generated by the parallel swage processing.

Japanese Patent Laid-open Publication No. 2002-46056 mentioned above discloses a device in which a medium is provided in the barrel to remove the burrs from a work using the medium. In the device, a door member is opened, the workpiece is inserted into the barrel, the door member is closed, and the workpiece W is rotated in the medium. Thus, the device has a complicated structure.

In the present embodiment, the barrel 26 includes the case 34 formed with the opening hole 33, and the drop prevention member 35 which prevents the polishing members 30 and 31 from being dropped from the opening hole 33. The gap 85 into which the tubular end section Wa of the workpiece W is inserted is formed between the opening hole 33 of the case 34 and the drop prevention member 35. Thus, when inserting the tubular end section Wa of the workpiece W from the gap 85 in which the drop of the polishing members 30 and 31 is regulated into the barrel 26, the tubular end section Wa of the workpiece W comes into contact with the polishing members 30 and 31 filled in the barrel 26, and the burrs are removed. Thus, the tubular end section Wa of the workpiece W may be inserted into the gap 85, and the opening and closing of the door member or the like become unnecessary. Thus the structure is simplified and the productivity can be improved.

Furthermore, the elastic members 36 and 37 are arranged in the case 34. For this reason, when inserting the tubular end section Wa of the workpiece W, the tubular end section Wa enters while pressing the polishing members 30 and 31 filled in the case 34 and deforming the elastic members 36 and 37. Thus, since the polishing members 30 and 31 are pressed against the tubular end section Wa of the workpiece W by the reaction force of the elastic members 36 and 37, the polishing members 30 and 31 can be brought into contact with the tubular end section Wa of the workpiece W without a gap. Furthermore, since the burrs of the tubular end section Wa can be reliably removed, the reliability can be improved.

Furthermore, since the motor 24 for rotating the barrel 26 is provided on the first of the barrel 26 and the clamp portion 18 for clamping the workpiece W is provided on the second side of the barrel 26, a further simple structure is obtained.

Furthermore, since the motor 24 rotates the barrel 26 in the normal rotation and reverse rotation, the polishing members 30 and 31 can be brought into contact with the burrs of various directions. That is, for example, in the reverse rotation, it is possible to scrape the burrs incapable of being scraped in the normal rotation. Thus, it is possible to more reliably remove the burrs oriented in various directions of the tubular end section Wa, and the reliability can be further improved.

Furthermore, since the large-diameter sections 52 and the small-diameter sections 51 are alternately arranged in the case 34, when the barrel 26 is rotated, the small-diameter sections 51 provided between the large-diameter sections 52 of the side wall section 41 of the case 34 function as a stopper of the relative movement of the polishing members 30 and 31 relative to the tubular end section Wa. Accordingly, a slipping phenomenon of the polishing members 30 and 31 generated in the configuration in which only the large-diameter sections 52 are arranged is eliminated, and as a consequence, the polishing members 30 and 31 are able to satisfactorily scrape the burrs from the tubular end section Wa. Thus, it is possible to more reliably remove the burrs of the tubular end section Wa, and the reliability can be further improved.

Furthermore, the large-diameter sections 52 and the small-diameter sections 51 are alternately arranged in the case 34. For this reason, the polishing members 30 and 31 can be stirred in the connection member, the polishing members 30 and 31 can be used on average, and thus exchange frequency of the polishing members 30 and 31 can be reduced.

Furthermore, since the large-diameter sections 52 and the small-diameter sections 51 are alternately arranged in the case 34, the thick portions 54 and the thin portions 55 are alternately formed in the side wall section 41. For this reason, by forming the screw holes 56 for attaching the lid member 44 in the thick portions 54 while making other portions the thin portions 55, it is possible to increase the volume of the filling space 87 filled with the polishing members 30 and 31. Thus, the filling amounts of the polishing members 30 and 31 can be increased, and thus the exchange frequency of the polishing members 30 and 31 can be reduced.

Furthermore, the case 34 has the case main body 43 opened at the first end thereof, and the lid member 44 having the opening hole 33 and attached to the first end side of the case main body 43. For this reason, it is possible to easily and reliably put the polishing device 30 and 31 of the full amount into the case 34.

Furthermore, the polishing members 30 and 31 are fully filled in the filling space 87 of the case 34. For this reason, when inserting the tubular end section Wa of the workpiece W into the case 34, the elastic members 36 and 37 can reliably generate the reaction force, and thus the polishing members 30 and 31 can be reliably pressed against the tubular end section Wa. Accordingly, it is possible to reliably remove the burrs of the tubular end section Wa, and the reliability can be further improved.

Furthermore, since the polishing members 30 and 31 are fully filled in the filling space 87 of the case 34, even if the center of the barrel 26 is arranged laterally along the lateral direction, a gap is not generated in the upper portion in the barrel 26. Accordingly, it is possible to suppress an increase in size in the longitudinal direction and reliably remove the burrs of the tubular end section Wa.

Furthermore, since the workpiece W is the cylinder 101 which is used in the shock absorber and engages the seal ring 105 by the tubular end section Wa, there is a high effect of reliably removing the burrs. That is, there is a high effect of preventing the scratch of the seal ring 105 by reliably removing the burrs to enhance the reliability.

In addition, in the position becoming the bottom section in the case 34, for example, in the cylindrical side wall section 41 in the present embodiment, small holes may be provided to an extent that the polishing members 30 and 31 do not fall off, to thereby discharge the removed burrs. Furthermore, a magnet may be arranged in the case 34, so that the burrs can be attached to the magnet. By providing the bur discharging means, the maintenance cycle can be extended, and the productivity can be improved.

According to the present embodiment mentioned above, there is provided a deburring device which includes a barrel with a granulated polishing members filled therein and removes the burrs of the tubular end section of the workpiece from the workpiece, wherein the barrel is constituted by the case formed with the opening hole, and the drop prevention member which is fixed to the case and prevents the polishing member from being dropped from the opening hole. A gap into which the tubular end section is inserted is formed between the opening hole of the case and the drop prevention member. Thus, when inserting the tubular end section of the workpiece from the gap in which the drop of the polishing member is regulated into the barrel, the tubular end section of the workpiece comes into contact with the polishing member filled in the barrel, and the burrs are removed. Accordingly, the tubular end section of the workpiece may be inserted into the gap, and since there is no need to open and close the door member, the structure is simplified, and the productivity can be improved.

Furthermore, since the configuration in which the elastic member is arranged in the case is provided, when inserting the tubular end section of the workpiece, the tubular end section presses the polishing member filled in the case and enters while deforming the elastic member. Thus, since the polishing members are pressed against the tubular end section of the workpiece by the reaction force of the elastic member, the burrs of the tubular end section can be reliably removed.

Furthermore, the configuration in which the driving device for rotating the barrel in the normal rotation and reverse rotation is arranged on the first of the barrel, and the clamp device for clamping the workpiece is arranged on the second side of the barrel is provided. For this reason, the structure is further simplified, and since the barrel is rotated in the normal rotation and reverse rotation, the polishing member can be brought into contact with the burrs of various directions, whereby it is possible to more reliably remove the burrs directed in various directions of the tubular end section.

Furthermore, since the configuration in which the large-diameter sections and the small-diameter sections are alternately arranged in the case is provided, when the barrel is rotated, the small-diameter sections provided between the large-diameter sections of the case function as the stopper of the relative movement of the polishing member relative to the tubular end section. As a consequence, the polishing members satisfactorily scrape the burrs from the tubular end section. Thus, the burrs of the tubular end section can be more reliably removed, and the reliability can be further improved. Additionally, the polishing member can be stirred in the connection section between the large-diameter sections 52 and the small-diameter sections 51, the polishing member can be used on average, and the exchange frequency of the polishing member can be reduced.

Furthermore, since the configuration in which the case has the case main body opened at the first end thereof, and the lid member having the lid hole and attached to the first end side of the case main body is provided, the polishing member can be easily and reliably put into the case.

Furthermore, since the workpiece is the cylinder used in the shock absorber, the effect of reliably removing the burrs is high, and the reliability of the shock absorber can be improved.

In addition, in the embodiment mentioned above, a case in which the burrs of the tubular end section Wa of the workpiece W generally forming the tubular shape are removed from the workpiece W has been described as an example. However, if the workpiece has the tubular end section, the workpiece may not generally form the tubular shape. For example, it is also possible to remove the burrs of the workpiece provided with the tubular end section at a tip of a solid shaft section.

For example, in the embodiment mentioned above, the motor 24 rotates the barrel 26 in the normal rotation and reverse rotation. Furthermore, the effect of reliably removing the burrs can be enhanced by being axially vibrated by the axial driving section 25.

Furthermore, in the embodiment mentioned above, the barrel is rotated in the normal rotation and reverse rotation and is vibrated axially. The barrel may be fixed and the workpiece side may be rotated and vibrated axially. Accordingly, the barrel and the workpiece may be relatively rotated and axially moved.

Furthermore, the inner periphery of the case may be a polygon, or a circular shape partially provided with a protrusion may be adopted.

While preferred embodiments of the present invention have been described, the present invention is not limited to the embodiments. Additions, omissions, substitutions, and other variations may be made to the present invention without departing from the spirit and scope of the present invention. The present invention is not limited by the above description, but by the appended claims.

The invention claimed is:

1. A method of manufacturing a cylinder by deburring burrs of a tubular end section of a workpiece from the workpiece using a deburring device which comprises a barrel capable of being filled with granulated polishing members therein, wherein the barrel comprises:

a case formed with an opening hole which has a larger diameter than an outer diameter of the tubular end section of the workpiece and into which the tubular end section of the workpiece is capable of being inserted, the case being filled with the polishing members; and a drop prevention member which is fixed to the case to prevent the polishing members from being dropped from the opening hole and comprises an insertion portion having a smaller diameter than an inner diameter of the tubular end section of the workpiece so that the insertion portion is capable of entering the tubular end section of the workpiece, wherein the drop prevention member forms a circular gap with respect to the opening hole such that the tubular end section of the workpiece can be inserted between the insertion portion and the opening hole of the case, and wherein the method comprises:

inserting the tubular end section of the workpiece into the circular gap of the barrel, and deburring burrs of the tubular end section from the workpiece by using the deburring device by rotating the workpiece and the barrel with respect to one another in a circumferential direction in a state in which the tubular end section is inserted into the circular gap.

2. The method of manufacturing a cylinder according to claim 1, wherein the deburring device further comprises a driving device connected to the barrel via a rotating shaft, and wherein the step of deburring burrs is performed by rotating the barrel by the driving device in a state in which the workpiece is fixed.

3. The method of manufacturing a cylinder according to claim 2, wherein the step of deburring burrs is performed by rotating the barrel in a normal rotation and a reverse rotation by the driving device.

4. The method of manufacturing a cylinder according to claim 2, wherein the deburring device further comprises a clamp device for clamping the workpiece, and wherein the step of inserting the tubular end section into the circular gap of the barrel is performed by moving the barrel toward the tubular end section in an axial direction of the workpiece after the workpiece is clamped by the clamp device.

5. The method of manufacturing a cylinder according to claim 1, wherein the workpiece is a cylinder used in a shock absorber.

6. A deburring device which removes burrs of a tubular end section of a workpiece from the workpiece, the deburring device comprising:

a barrel capable of being filled with granulated polishing members therein, wherein the barrel comprises:

a case formed with an opening hole which has a larger diameter than an outer diameter of the tubular end section of the workpiece and into which the tubular end section of the workpiece is capable of being inserted, the case being filled with the polishing members; and a drop prevention member which is fixed to the case and which prevents the polishing members from being dropped from the opening hole, the drop prevention member comprising an insertion portion having a smaller diameter than an inner diameter of the tubular end section of the workpiece so that the insertion portion is capable of entering the tubular end section of the workpiece, and wherein the drop prevention member forms a circular gap with respect to the opening hole such that the tubular end section of the workpiece is capable of being inserted between the insertion portion and the opening hold of the case.

7. The deburring device according to claim 6, wherein an elastic member is arranged in the case.

8. The deburring device according to claim 6, wherein a driving device for rotating the barrel in normal rotation and reverse rotation are arranged on a first side of the barrel in an axial direction, the driving device being connected to the barrel via a rotating shaft.

9. The deburring device according to claim 8, wherein a clamp device for clamping the workpiece which is inserted into the gap of the barrel is installed on a second side of the barrel in the axial direction and is separated from the barrel.

10. The deburring device according to claim 9, wherein the driving device is a motor comprising the rotational shaft, and the motor is configured to be capable of moving back and forth in the axial direction of the workpiece when the workpiece is clamped by the clamp device.

11. The deburring device according to claim 6, wherein the case has a cylindrical shape, the case has small-diameter sections and large-diameter sections provided on an inner circumferential surface of a side wall of the case, the large-diameter sections have a smaller radius of curvature than a radius of curvature of the small-diameter sections and a larger maximum outer diameter than a maximum diameter of the small-diameter sections, the small-diameter sections and the large-diameter sections are alternately arranged on the inner circumferential surface of the side wall of the case, and a protrusion is provided between each of the small-diameter sections and large-diameter sections.

12. The deburring device according to claim 6, wherein the case has a case main body opened at a first end thereof, and a lid member which has the opening hole and is attached to the first of the case main body.

13. The deburring device according to claim 6, wherein a clamp device for clamping the workpiece which is inserted into the gap of the barrel is installed on a second side of the barrel in an axial direction and is separated from the barrel.

14. The deburring device according to claim 6, wherein the opening hole of the case faces the insertion portion of the drop prevention member in a radial direction of the case, and an outer circumferential surface of the drop prevention member comprises a tapered outer circumferential surface in which a diameter of the tapered outer circumferential surface becomes smaller toward a tip side of the drop prevention member that is inserted into the workpiece.

15. The deburring device according to claim 6, wherein the gap comprises a minimum gap section which is configured to be narrower than a length of the portion having the predetermined minimum length of the polishing members in an original state.

16. A deburring device which removes burrs of a tubular end section of a workpiece from the workpiece, the deburring device comprising:

a barrel capable of being filled with granulated polishing members therein, wherein the barrel comprises:

a case formed with an opening hole; and a drop prevention member which is fixed to the case and which prevents the polishing members from being dropped from the opening hole, where a gap, into which the tubular end section is capable of being inserted, is formed between the opening hole of the case and the drop prevention member, wherein a driving device for rotating the barrel in normal rotation and reverse rotation is arranged on a first side of the barrel in an axial direction, the driving device being connected to the barrel via a rotating shaft, and wherein a clamp device for clamping the workpiece which is inserted into the gap of the barrel is installed on a second side of the barrel in the axial directed and is separated from the barrel.

17. The deburring device according to claim 16, wherein the case has a cylindrical shape, the case has small-diameter sections and large-diameter sections provided on an inner circumferential surface of a side wall of the case, the large-diameter sections have a smaller radius of curvature than a radius of curvature of the small-diameter sections and a larger maximum outer diameter than a maximum diameter of the small-diameter sections, the small-diameter sections and the large-diameter sections are alternately arranged on the inner circumferential surface of the side wall of the case, and a protrusion is provided between each of the small-diameter sections and large-diameter sections.

18. The deburring device according to claim 16, wherein the case has a case main body opened at a first end thereof, and a lid member which has the opening hole and is attached to the first end of the case main body.

19. The deburring device according to claim 16, wherein the driving device is a motor comprising the rotational shaft, and the motor is configured to be capable of moving back and forth in the axial direction of the workpiece when the workpiece is clamped by the clamp device.

20. The deburring device according to claim 16, wherein the opening hole of the case faces the insertion portion of the drop prevention member in a radial direction of the case, and an outer circumferential surface of the drop prevention member comprises a tapered outer circumferential surface in which a diameter of the tapered outer circumferential surface becomes smaller toward a tip side of the drop prevention member that is inserted into the workpiece.

21. The deburring device according to claim 16, wherein the gap comprises a minimum gap section which is configured to be narrower than a length of the portion having the predetermined minimum length of the polishing members in an original state.

* * * * *